US010865628B2

(12) United States Patent
Dieckmann et al.

(10) Patent No.: US 10,865,628 B2
(45) Date of Patent: Dec. 15, 2020

(54) ANTENNA OPERATION FOR RESERVOIR HEATING

(71) Applicant: Chevron U.S.A. Inc., San Ramon, CA (US)

(72) Inventors: Gunther H. Dieckmann, Walnut Creek, CA (US); Cesar Ovalles, Walnut Creek, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 98 days.

(21) Appl. No.: 16/223,944

(22) Filed: Dec. 18, 2018

(65) Prior Publication Data

US 2019/0145236 A1 May 16, 2019

Related U.S. Application Data

(63) Continuation of application No. 15/192,210, filed on Jun. 24, 2016, now Pat. No. 10,184,330.

(60) Provisional application No. 62/183,789, filed on Jun. 24, 2015.

(51) Int. Cl.
*E21B 43/24* (2006.01)
*H05B 6/62* (2006.01)

(52) U.S. Cl.
CPC ..... *E21B 43/2401* (2013.01); *H05B 6/62* (2013.01); *H05B 2214/03* (2013.01)

(58) Field of Classification Search
CPC ..... E21B 43/2401; E21B 36/04; G01R 31/14
See application file for complete search history.

(56) References Cited

U.S. PATENT DOCUMENTS

| | | | |
|---|---|---|---|
| 3,170,519 | A | 2/1965 | Haagensen |
| 4,140,180 | A | 2/1979 | Bridges et al. |
| 4,485,868 | A | 12/1984 | Sresty et al. |
| 4,485,869 | A | 12/1984 | Sresty et al. |
| 4,508,168 | A | 4/1985 | Heeren |

(Continued)

OTHER PUBLICATIONS

Clearco "Material Safety Data Sheet PSF-5cSt pure Silicone Fluid", Oct. 15, 2014 (Year: 2014).*

(Continued)

*Primary Examiner* — Kipp C Wallace

(57) ABSTRACT

Systems and methods are provided for maintaining the performance and operational stability of an RF (radio frequency) antenna that is positioned in a hydrocarbon-bearing formation, for heating the formation using electromagnetic energy in the radio frequency range. Contaminants such as water or brine, metallic particulates and ionic or organic materials frequently occur in a wellbore being prepared for RF heating, or in an RF antenna installed in the wellbore. Prior to applying RF electrical energy to the formation, the antenna is decontaminated by circulating a preconditioning fluid through the antenna and recovering a spent fluid for treating and recycle. Decontamination is continued while the spent fluid from the antenna includes, but not limited to, water, metallic particles, ionic species, organic compounds contaminants, etc. An operational power level of radio frequency electrical energy is then applied to the decontaminated antenna for providing thermal energy to the hydrocarbon-bearing formation.

24 Claims, 3 Drawing Sheets

(56) References Cited

U.S. PATENT DOCUMENTS 4,583,589 A * 4/1986 Kasevich ..... E21B 36/04 166/248
4,620,593 A 11/1986 Haagensen
4,817,711 A 4/1989 Jeambey
4,912,971 A 4/1990 Jeambey
5,199,488 A * 4/1993 Kasevich ..... B09C 1/062 166/248
5,333,698 A * 8/1994 Van Slyke ..... C09K 8/34 175/65
5,829,519 A * 11/1998 Uthe ..... B09C 1/06 166/60
6,879,297 B2 4/2005 Brown et al.
6,891,501 B2 5/2005 Rawnick et al.
6,906,668 B2 6/2005 Rawnick et al.
6,967,628 B2 11/2005 Rawnick et al.
7,084,828 B2 8/2006 Rawnick et al.
7,441,597 B2 10/2008 Kasevich
7,691,258 B2 4/2010 Venkateshan
7,891,421 B2 2/2011 Kasevich
8,616,273 B2 12/2013 Trautman et al.
8,807,220 B2 8/2014 Madison et al.
8,877,041 B2 11/2014 Parsche
9,016,367 B2 4/2015 Wright et al.
9,267,365 B2 2/2016 Dittmer et al.
9,284,826 B2 3/2016 Campbell et al.
9,416,639 B2 * 8/2016 Whitney ..... E21B 43/122
9,453,400 B2 9/2016 Wheeler et al.
9,653,812 B2 5/2017 Okoniewski et al.
9,856,724 B2 * 1/2018 White ..... E21B 43/2401
9,863,227 B2 * 1/2018 Wright ..... E21B 43/2401
10,184,330 B2 1/2019 Dieckmann et al.
2006/0163529 A1 * 7/2006 Jokinen ..... C09K 5/20 252/73
2011/0073796 A1 * 3/2011 Dunuwila ..... C09K 5/10 252/70
2011/0132661 A1 6/2011 Harmason et al.
2013/0304436 A1 11/2013 Parsche et al.
2014/0216714 A1 * 8/2014 Dittmer ..... H01R 13/005 166/57
2014/0239940 A1 * 8/2014 Meltzer ..... G01R 21/02 324/95
2015/0013985 A1 1/2015 Parsche
2015/0285033 A1 10/2015 Noel et al.
2017/0137687 A1 * 5/2017 Rodney ..... E21B 33/13

OTHER PUBLICATIONS

Clearco "product information Sheet PSF-5cSt pure Silicone Fluid", Oct. 15, 2014 (Year: 2014).*
Kasevich, R.S., et al.; "Pilot Testing of a Radio Frequency Heating System for Enhanced Oil Recovery from Diatomaceous Earth"; SPE 28619, Sep. 1994, pp. 105-113, with 5 drawing pages and 1 corrections and clarifications page.
Kelland, Malcolm A.; "Production Chemicals for the Oil and Gas Industry"; CRC, 1st Edition, (2009), Chapter 11—Demulsifiers, Title pages (2), and pp. 296-300.
Rudnick, Leslie R. (Ed.); "Lubricant Additives Chemistry and Applications"; CRC, 2nd Edition, (2003), Chapter 5—Dispersants, Title pages (2), and pp. 143-144 (Dispersants).

* cited by examiner

ANTENNA OPERATION FOR RESERVOIR HEATING

CROSS REFERENCE TO RELATED APPLICATIONS

The present application claims priority and benefit as a continuation patent application from U.S. application Ser. No. 15/192,210, filed on Jun. 24, 2016, which is incorporated by reference in its entirety. This application claims benefit under 35 USC 119 of US Provisional Patent Application No. 62/183,789 with a filing date of Jun. 24, 2015, which is incorporated herein by reference in its entirety.

FIELD OF THE INVENTION

The invention relates to the use of radiofrequency (RF) as source of energy for heating underground hydrocarbon-bearing formations.

BACKGROUND

The use of radiofrequency (RF) as source of energy for heating underground hydrocarbon-bearing formations is well known. U.S. Pat. Nos. 3,170,519 and 4,620,593 disclose an apparatus to generate the RF at the surface and a coaxial or waveguide to take the energy downhole. U.S. Pat. No. 4,485,868 describes similar equipment with small modifications to be used for electromagnetic heating of hydrocarbon-bearing formations. U.S. Pat. Nos. 4,912,971 and 4,817,711 disclose a downhole microwave generator in which the wellbore is used as a waveguide and the dielectric constants of the formation can be measured and the system can be optimized to reach temperatures up to 400° C. U.S. Pat. Nos. 4,140,180 and 4,485,869 describe three waveguides inserted into the ground to heat a hydrocarbon-bearing formation.

SPE 28619, presented at 69th Annual Tech. Conf. New Orleans, La., USA, Sep. 25-28 (1994) discloses a field test using an RF heating system, including a coaxial line, and a dipole antenna to bring the energy downhole to heat the formation. U.S. Pat. No. 7,891,421 describes a method and apparatus for radiating a RF electromagnetic wave into a hydrocarbon-bearing formation in which two parallel horizontal wells are placed. The RF antenna is configured within the well and allows passage of fluids there through.

Radiofrequency heating has also been disclosed for heating a petroleum/brine-containing formation prior to the injection of any fluid downhole for enhanced oil recovery as in U.S. Pat. App. No. 2014-0262225. Once the formation is heated to a desired temperature, a portion of the indigenous liquids (oil and brine) is produced in order to create a void for the injection of fluids for enhanced oil recovery.

There are many different types of RF antenna that can be used to heat a formation. Some of these antennas can be placed in a well containing nitrogen or other inert gas, while other RF antennas will work better if placed in a well containing an insulating fluid; also known as the "operating fluid". Allowing an insulating fluid to fill the antenna allows for cooling of hot spots that may develop during operation. This can be accomplished by circulating the insulating fluid through the antenna during operation or by allowing heat transfer by convention and/or conduction. The operating or insulating fluid also serves a role of maintaining pressure balance in the well, thus preventing fluids outside of casing from easily entering the well, which could then short out the antenna.

While RF antennas are known for installation into a wellbore for heating a hydrocarbon-bearing formation, little attention has focused on the real-world issues of operating a high voltage system in the downhole environment, in which brine and other conductive materials from the wellbore, rig, and other equipment as well as metallic fragments remaining in the antenna from construction and installation, may adversely affect antenna performance and operational stability. For example, the fluid within the wellbore will most likely include these "conductive contaminates" because field operations are conducted in a "conductively dirty" environment and the fluid in the wellbore will, unless extreme measures are taken, be "conductively contaminated" with a high enough level of conductive particles. As such, it becomes highly unlikely that a high voltage signal can be applied to the antenna without developing an electrical short.

SUMMARY OF THE INVENTION

In one aspect, the invention relates to a method for RF heating a subterranean formation. The method comprises: providing a wellbore extending at least into a hydrocarbon-bearing formation; providing an RF antenna in the wellbore to extend at least into the hydrocarbon-bearing formation, wherein the antenna includes at least one passageway for fluid flow; providing a generating unit for generating electromagnetic energy of at least one RF frequency; and providing a transmission line in electrical communication with the generating unit and in electrical communication with the RF antenna for transmitting electromagnetic energy from the generating unit to the decontaminated RF antenna and wellbore to provide thermal energy to the hydrocarbon-bearing formation. The RF antenna is decontaminated by circulating a preconditioning fluid through the at least one passageway of the antenna for at least one wellbore volume to generate a spent fluid having less than 40 ppm water.

Further to the invention is a system for enhanced oil recovery, comprising a wellbore extending into a hydrocarbon-bearing formation, where the wellbore comprises an RF transparent casing string in at least a portion of the hydrocarbon-bearing formation; an RF antenna extending into the RF transparent casing and forming an annular volume within the wellbore between the RF transparent casing and the antenna; a generating unit for generating electromagnetic energy of at least one RF frequency; a transmission line in electrical communication with the generating unit and in electrical communication with the RF antenna for transmitting electromagnetic energy from the generating unit to the RF antenna; a treating unit in liquid communication with the antenna and with the annular volume; means for circulating preconditioning fluid from the treating unit to the antenna; and means for recovering spent fluid from the antenna.

In another aspect, the invention relates to a preconditioning fluid for removing contaminants from an RF antenna within a wellbore extending into at least a portion of a hydrocarbon-bearing formation, where the preconditioning fluid is characterized as having a viscosity of less than 5 cP at 100° C., containing less than 0.5 wt. % aromatics; where the preconditioning fluid comprises a base fluid having a jet fuel boiling range or a diesel fuel boiling range, the base fluid containing less than 0.5 wt. % monoaromatics and less than 0.01 wt. % diaromatics; and where the preconditioning fluid is characterized has containing less than 40 ppm of dissolved water, free water, emulsified water, or any combination thereof.

DETAILED DESCRIPTION OF THE INVENTION

Figure 1:
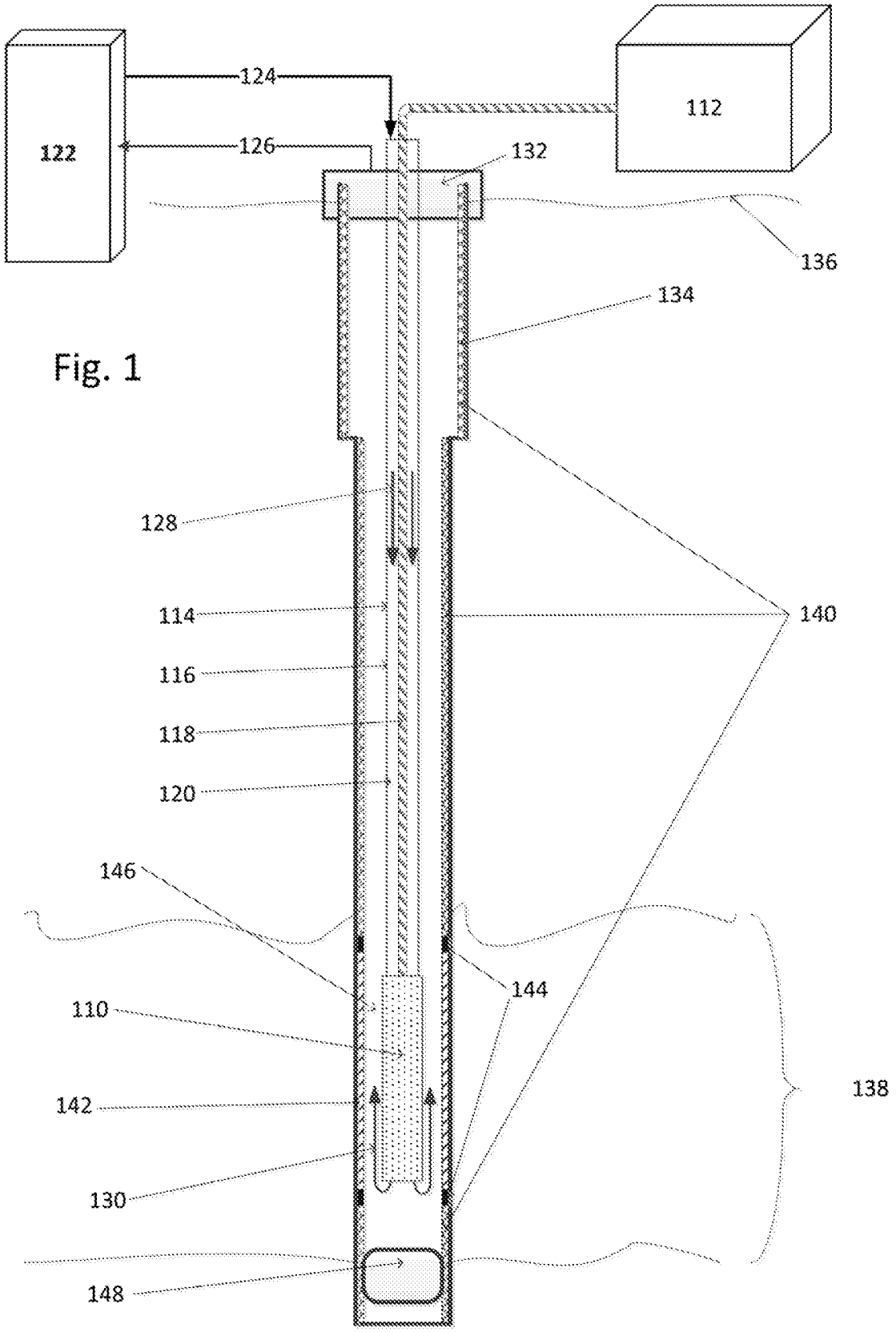
FIG. 1 illustrates an embodiment of the RF heating system.

The following terms will be used throughout the specification and will have the following meanings unless otherwise indicated.

"Petroleum oil" refers to a liquid hydrocarbon material. "Hydrocarbon" refers to solid, liquid or gaseous organic material of petroleum origin, that is principally hydrogen and carbon, with significantly smaller amounts (if any) of heteroatoms such as nitrogen, oxygen and sulfur, and, in some cases, also containing small amounts of metals. In one embodiment, the term petroleum oil refers to crude oil. Crude, crude oil, crudes and crude blends are used interchangeably and each is intended to include both single crude and blends of crudes.

In one embodiment, the petroleum oil that is recovered from the hydrocarbon-bearing formation is heavy petroleum oil, which may flow slowly, if at all, during petroleum oil production. In one embodiment, the heavy petroleum oil is solid at the temperature and the pressure of the hydrocarbon-bearing formation. The petroleum oil that is produced from the hydrocarbon-bearing formation may range from light to extra heavy crude oil.

According to the American Petroleum Institute (API) gravity scale, light crude oil is defined as having an API gravity greater than 31.1° API (less than 870 kg/m3), medium crude oil is defined as having an API gravity between 22.3° API and 31.1° API (870 to 920 kg/m3), heavy crude oil is defined as having an API gravity between 10.0° API and 22.3° API (920 to 1000 kg/m3), and extra heavy crude oil is defined with API gravity below 10.0° API (greater than 1000 kg/m3).

"Jet fuel boiling range" refers to hydrocarbons having a boiling range in the temperature range from 280° F. to 572° F. (138° C. to 300° C.). "Diesel fuel boiling range" refers to hydrocarbons having a boiling range in the temperature range from 250° F. to 1000° F. (121° C. to 538° C.). "Boiling range" is the temperature range between the 5 vol. % boiling point temperature and the 95 vol. % boiling point temperature, inclusive of the end points, as measured by ASTM D2887-08 ("Standard Test Method for Boiling Range Distribution of Petroleum Fractions by Gas Chromatography"). Boiling point properties as used herein are normal boiling point temperatures, based on ASTM D2887-08.

"Ambient conditions" are the natural temperature and pressure at the earth's surface. For example, ambient conditions are characterized by a temperature of 20° C. and a pressure of 1 atm (101 kPa).

"Dielectric constant" refers to the relative permittivity (ε') of a material, as determined by the standard relative capacitance method. Dielectric constants of solid and liquid dielectrics may be determined, for example, using ASTM D2149 and ASTM D924 respectively. Dielectric constant is equal to the ratio $\varepsilon = Cs/Cv$, where Cs is a measured capacitance with the specimen as the dielectric, and Cv is a measured capacitance with a vacuum as the dielectric.

"Loss tangent" refers to a quantity that represents a dielectric material's inherent dissipation of electromagnetic energy into heat, i.e. the lossiness of the material. A related "loss factor", which is the loss tangent times the dielectric constant, measures the energy dissipated by a dielectric when in an oscillating field. The analytical techniques to measure Loss tangents are well known in the literature such as ASTM Test Method D-150.

"Dielectric breakdown" refers to the formation of electrically conducting regions in an insulating material exposed to a strong electric field. A "dielectric breakdown voltage" refers to the voltage across a dielectric material above which there is a rapid reduction in the resistance to flow of electricity through the dielectric material. It is thus an electric field at which a material that is normally an electrical insulator begins to conduct electricity. The analytical techniques to measure dielectric breakdown are well known in the literature such as ASTM Test Method D-877 and D-1816.

"Conductor" is an object or type of material which permits the flow of electric charges in one or more directions.

"Dielectric material" refers to an electrical insulator that can be polarized by an applied electric field. When a dielectric material is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field that reduces the overall field within the dielectric material itself. If a dielectric material is composed of weakly bonded molecules, those molecules not only become polarized, but also reorient so that their symmetry axes align to the field. The dielectric material in a transmission line may be a liquid, a solid, a gaseous substance, or any combination thereof.

"Preconditioning fluid" refers to the fluid in the well before the antenna is turned on, for use to clean and/or prepare the antenna for operation. "Well" may be used interchangeably with "wellbore."

"Operating fluid" refers to the fluid in the well and in contact with the antenna when the antenna and well fluids have been conditioned so that RF voltage can be applied to the antenna without developing an electrical short or breakdown of the antenna. "Insulating fluid" may be used interchangeably with "operating fluid."

"Spent fluid" refers to the fluid that is removed from the well for treatment. Once treated, the fluid can be returned to the well.

Reference is made to locations relative to the earth's "surface." It will be understand that any reference to the earth's surface is to be interpreted in general terms. The reference surface for a land-based installation is the land surface. The reference surface for a water-based installation is the water surface.

"Surface facility" as used herein is any structure, device, means, service, resource or feature that occurs, exists, takes place or is supported on the surface of the earth.

"Hydrocarbon-bearing formation" is a geological, subsurface formation in which hydrocarbons occur and from which they may be produced. For example, a "low-permeability hydrocarbon-bearing formation," as defined herein, refers to formations having a permeability of less than about 10 millidarcies, wherein the formations comprise hydrocarbonaceous material. Examples of such formations include, but are not limited to, diatomite, coal, tight shales, tight sandstones, tight carbonates, and the like. The antenna, systems, and methods are also suitable for enhancing hydrocarbon recovery from a low-permeability hydrocarbon-bearing formation. Such formations can be found in the San Joaquin Valley, Calif., Athabasca Oil sands in Alberta, Canada, Permian Basin in west Texas, Marcellus Shales, Eastern US and others.

"In situ" refers to within the subterranean formation.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if a composition is described herein as including a component of type A, a component of type B, a component of type C, or any combination thereof, it is understood that this phrase describes all of the various individual and collective combinations and permutations of these components. For example, in some embodiments, the composition described by this phrase could include only a component of type A. In some embodiments, the composition described by this phrase could include only a component of type B. In some embodiments, the composition described by this phrase could include only a component of type C. In some embodiments, the composition described by this phrase could include a component of type A and a component of type B. In some embodiments, the composition described by this phrase could include a component of type A and a component of type C. In some embodiments, the composition described by this phrase could include a component of type B and a component of type C. In some embodiments, the composition described by this phrase could include a component of type A, a component of type B, and a component of type C. In some embodiments, the composition described by this phrase could include two or more components of type A (e.g., A1 and A2). In some embodiments, the composition described by this phrase could include two or more components of type B (e.g., B1 and B2). In some embodiments, the composition described by this phrase could include two or more components of type C (e.g., C1 and C2). In some embodiments, the composition described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the composition described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the composition described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

Unless defined otherwise, all technical and scientific terms used herein have the same meanings as commonly understood by one of skill in the art to which the disclosed invention belongs.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims, etc. All citations referred herein are expressly incorporated herein by reference.

Antenna Preconditioning:

The present invention relates to methods and mechanisms for preconditioning an RF antenna for RF heating of a subterranean formation, such as a hydrocarbon-bearing formation. A RF heating system provides radio frequency electrical energy through an RF antenna to a hydrocarbon-bearing formation for generating thermal energy in the formation. The system includes a wellbore, in which an antenna is located for providing the radio frequency electrical energy to the formation.

RF signals from an RF generator (also referred to herein as a generating unit) are converted into electromagnetic energy, which is emitted from the antenna in the form of electromagnetic waves. The electromagnetic waves E pass through the wellbore and into the hydrocarbon-bearing formation, causing dielectric heating to occur, due to the molecular oscillation of polar molecules present in the hydrocarbon-bearing formation caused by the corresponding oscillations of the electric fields of the electromagnetic waves E. The system also includes a transmission line in electrical communication with the RF generator and with the antenna for delivering RF electrical energy from the generator to the antenna. The system also includes a dielectric fluid circulation system for maintaining the long term, effective operation of the antenna in enhanced crude oil production from the formation.

The RF generator includes electronic components, such as a power supply, an electronic oscillator, a power amplifier, and an impedance matching circuit. The frequency of the electric signal generated by the RF generator is generally in a range from about 5 kHz to about 20 MHz, and in one embodiment in a range from about 50 kHz to about 3 MHz. The frequency may be fixed at a single frequency, or multiple frequencies may be used at the same time. The RF generator generally produces an electric signal having an operational power level in a range from about 50 kilowatts to about 2 megawatts. Alternatively, the power is selected to provide at least a minimum amount of power per unit length of the antenna. In one embodiment, the minimum amount of power per unit length of the antenna is in a range from about 0.5 kW/m to 5 kW/m; in other embodiments an antenna generates more, or less, power.

While a preliminary cleaning of the antenna following construction is desired, preconditioning the installed antenna within the wellbore is performed to remove all contaminants, such as conductive contaminants, introduced or present during the installation process. Thus, in one embodiment, the RF antenna is installed within the wellbore prior to preconditioning, and preconditioning is carried out to remove contaminants from the antenna prior to use for heating the formation. The contaminants can be materials remaining in the antenna after construction and after installation in the formation, which have the potential of adversely affecting the performance or the longevity of the antenna during the heating operation. The RF antenna for use in RF heating (as located in a wellbore) is sufficiently free of contaminants, such that any remaining contaminants will not adversely affect the short term and long term performance of the antenna for heating the hydrocarbon-bearing formation.

In one embodiment, the wellbore is first prepared to receive the antenna. Example preparations include installation of well casing, such as transparent well casing, that does not impact RF radiation. In this context, the term "transparent" means that the material transmits RF radiation without changing the amplitude or phase of the RF radiation sufficiently to degrade the performance of the system. Example materials that are suitable for use as well casing material and are transparent to RF radiation include, but not limited to, plastic materials such as polyethylene, polypropylene, PEEK, PPS, block co-polymers, epoxy fiberglass composites, or any combination thereof. In one embodiment, the casings are fiberglass wound composite bodies made with high temperature oil field chemical resistant epoxy resins such as aromatic amine cross linked epoxy resin and low dielectric glass fiber. In another embodiment, a suitable material may be a dielectric material having both a near-zero loss tangent and a dielectric constant less than 7 in the selected portion of the RF spectrum.

Another example of preparation involves drilling the wellbore using hydrocarbon-based drilling and completion fluids, thus eliminating to the extent possible the incursion of water into the wellbore. After installation, the antenna is cleaned with a hydrocarbon-based preconditioning fluid, such that no more than 40 ppm of water is introduced to the antenna during cleaning. The preconditioning fluid is circulated through the antenna until the spent fluid recovered from the cleaning process contains less than 40 ppm of water, e.g., less than 40 ppm dissolved water in one embodiment, less than 40 ppm free water in another embodiment, less than 40 ppm emulsified water in another embodiment, less than 40 ppm of dissolved water, free water, and emulsified water combined in another embodiment.

In one embodiment, the wellbore is drilled using water based fluids for at least a portion of the drilling and well completion process. The water based fluid in the well is exchanged with a hydrocarbon-based fluid, and the antenna is installed. As a result the hydrocarbon based fluid contained within the wellbore is contaminated by the initial water based fluid. The installed antenna is used to circulate preconditioned hydrocarbon fluid through the well until the spent fluid recovered contains less than 40 ppm water.

In one embodiment, the completed well may contain water based fluids that is then subsequently replaced with a hydrocarbon based fluid prior to installation of the antenna. This hydrocarbon fluid may be cleaned in a manner described herein by circulating the fluid through a tubing string.

In another embodiment, the hydrocarbon fluid is run through a clay treater such as described in U.S. Pat. No. 7,691,258 and references therein to remove polar components. Removal of polar compounds containing nitrogen, oxygen, sulfur, or any combination thereof can improve the ability of water to settle from the spent fluid. For example, the clay treater may contain attapulgus clay. U.S. Pat. No. 7,691,258 is incorporated herein by reference in its entirety.

In another embodiment, the antenna is installed into the well that contains water based fluid, since some contaminants can be removed in aqueous phase (e.g., salts, water based cutting oils, and some metal particulates). The water based fluid in the well is then replaced with a hydrocarbon based fluid. The antenna is then preconditioned with a hydrocarbon-based preconditioning fluid that removes the last traces of water and other contaminants from the antenna, to a water content of the spent fluid exiting the antenna of 40 ppm or less.

Antenna:

In one aspect, a method for preconditioning a RF antenna prior to operation to heat the formation includes providing a wellbore extending at least into a hydrocarbon-bearing formation, and providing an RF antenna in a wellbore to extend at least into a portion of the hydrocarbon-bearing formation, wherein the antenna includes at least one passageway for fluid flow. The RF antenna is a device that converts electric energy into radiant electromagnetic energy in the radio frequency range. The frequency of the electric signal is generally in a range from about 5 kHz to about 20 MHz in one embodiment, and in a range from 50 kHz to 3 MHz in another embodiment.

In one embodiment, the antenna is positioned within the wellbore at a depth which is coincident with the depth of the hydrocarbon-bearing formation. The electromagnetic waves are converted by the formation into thermal energy, which heats the formation and enhances hydrocarbon (e.g., oil) production. The antenna is in electrical connection with the transmission line, and receives radio frequency electrical energy from the RF generator through the transmission line. The antenna can be of any form which requires an insulating fluid, e.g., coaxial form, dipole, mono-pole, multi-pole, or other forms known in the art. Thus, the RF antenna is a coaxial antenna, a dipole antenna, a mono-pole antenna, or a multi-pole antenna. Examples of antennas for RF heating of hydrocarbon-bearing formations are disclosed in U.S. Pat. Nos. 9,016,367B2, 887,704B2, 7,084,828B2, 6,967,628B2, 6,906,668B2, 6,891,501B2, 6,879,297B2, incorporated herein by reference in their entirety.

Preconditioning Fluid:

The preconditioning fluid is formulated for removing any source of contamination that may reside in the installed antenna in the wellbore. Scrupulous cleaning to remove all traces of water, metal particulates, salts, or any other materials that could potentially create adverse electrical conductivity pathways is desirable. It may also be desirable, for optimal antenna performance, to remove traces of cutting oils that may be been left on antenna surfaces from construction, installation, or both.

The circulating preconditioning fluid composition that is used in the RF heating system includes a base fluid, in which one or more additives may be dissolved or dispersed to make the composition. The base fluid may comprise a hydrocarbon fraction, mineral oil, silicon oil, ester-based oil, or any combination thereof. An aqueous base fluid may also be used for preliminary antenna cleaning to remove water soluble contaminants, so long as the water remaining from the preliminary cleaning is scrupulously removed by a non-aqueous base fluid prior to activating the antenna.

In another aspect, the invention relates to a preconditioning fluid for removing contaminants from an RF antenna within a wellbore extending into at least a portion of a hydrocarbon-bearing formation, comprising a viscosity of less than 5 cP at 100° C., containing less than 0.5 wt. % aromatics; less than 40 ppm of dissolved water, free water, emulsified water, or any combination thereof. The preconditioning fluid may have a pH in a range from 6.0 to 8.0. In one embodiment, the preconditioning fluid comprises a base fluid comprising a jet fuel boiling range (hydrocarbon fraction) and a diesel fuel boiling range (hydrocarbon fraction), the base fluid containing less than 0.5 wt. % mono-aromatics and less than 0.01 wt. % di-aromatics.

Hydrocarbon fractions, including jet fuel boiling range materials or diesel fuel boiling range materials may be used, either alone or in combination, as base fluids for the circulating preconditioning fluid composition. In one embodiment, the circulating preconditioning fluid composition contains mono-aromatics, with at most trace amounts (i.e., less than 0.01 wt. %) of di-aromatics. In one embodiment, the preconditioning fluid comprises a base fluid comprising a jet fuel boiling range (hydrocarbon fraction) and a diesel fuel boiling range (hydrocarbon fraction), the base fluid containing less than 0.5 wt. % mono-aromatics and less than 0.01 wt. % di-aromatics. Such fluids contain low amounts of aromatics and have a distillation end point no greater than 600° F.

In one embodiment, the preconditioning fluid contains less than 0.5 wt. % mono-aromatics. Paraffinic fluids are also useful as base fluids for the circulating preconditioning fluid composition. In one embodiment, at least 90 wt. % of the base fluid composition is paraffinic; in one embodiment, at least 95 wt. %; and in one embodiment at least 99 wt. % of the base fluid composition is paraffinic.

Preconditioning fluid may be supplied to the antenna, for example, through a supply conduit provided for the purpose, through the transmission line, or through a combination, either in serial or in parallel configuration. The flow of preconditioning fluid through the antenna is generally greater than 1 gallon/min, and often in a range from 1 gallon/min to 100 gallons/min.

In one embodiment, the preconditioning fluid further comprises from 10 to 5000 ppm of one or more dispersants; from 10 to 5000 ppm of one or more detergents; from 10 to 500 ppm of one or more demulsifying agents; and from 10 to 500 ppm of one or more oxygen scavengers. In one embodiment, the preconditioning fluid further comprises from 10 to 5000 ppm thickening agents and/or metal, oxide, or sulfide conductive particle dispersal additives.

Optional Additives:

Additives may also be included in the circulating preconditioning fluid to facilitate antenna operation. In addition to providing cooling for the antenna (e.g., coaxial antenna), the preconditioning fluid may be formulated to control the effect of conductive particulates on antenna operation, including metal particles that may be generated during fabrication, deployment, or use of the antenna. Conductive particles also include oxides and chalcogenides. These deposited conductive particles have the potential of producing electric arcing in transmission lines and antennas, as well as reducing the dielectric breakdown of circulating preconditioning fluids during downhole RF heating operation. Even very low amounts of conductive particles within the antenna can form dendrites as a result of the electric field and electric field gradient, which if the dendrite is of sufficient length will short out the antenna or transmission line. Dispersants may be included in the fluid to decrease the effect of the metal particles on antenna operation. The dispersant agent facilitates dispersing metal particles from the antenna in the preconditioning fluid, for the preconditioning fluid circulation system to remove them by filtration, decantation, electrostatic separation (AC or DC), or any combination thereof.

Optional Dispersants:

Suitable dispersants may comprise of a polar group, usually oxygen- or nitrogen-based, and a large nonpolar group. The dispersant functions by attaching the polar group end of the dispersant to the metal or conductive contaminate particles, while the nonpolar end of the dispersant keeps such particles suspended in the preconditioning fluid. Non-limiting example dispersants that may be useful for providing in the preconditioning fluid include succinimides, succinates esters, alkylphenol amides, benzylamine, and other ashless dispersants. The amount of included dispersant depends to some extent on the particular application, and will generally range from 10 to 5000 ppm, based on the preconditioning fluid. In embodiments, the preconditioning fluid contains in a range from 100 to 2500 ppm of a dispersant. Succinimide, benzylamine, and other ashless dispersants may be obtained by modifying the succinimide or benzylamine with an organic acid, an inorganic acid, an alcohol, or an ester. The succinimide dispersant is prepared, for instance, by reacting polybutene having an average molecular weight in the range of 800 to 8,000 or a chlorinated polybutene having an average molecular weight in the range of 800 to 8,000 with maleic anhydride at a temperature of 100 to 200° C., and then with a polyamine. Examples of the polyamines include diethylenetriamine, triethylenetetramine, tetraethylenepentamine, pentaethylenehexamine, and hexaethyleneheptamine. The dispersant may be borated or non-borated. Thus, the dispersant employed in the invention can be obtained by reacting the above-mentioned polybutenyl-succinic acid-polyamine reaction compound with boric acid or a boric acid derivative. In some embodiments, the preconditioning fluid may include from 10 to 5000 ppm of one or more dispersants, and the dispersant may comprise a succinimide, a succinates ester, an alkylphenol amide, or any combination thereof.

Detergents:

The preconditioning fluid may be formulated to control the effect of other contaminants that are introduced during fabrication or use of the antenna. Examples include dust or dirt particles from the environment, and cutting oils or fluids used to fabricate and install the antenna. These contaminants increase the dielectric properties of circulating preconditioning fluids and, in general, diminish the efficiency of the RF heating system. Detergents may be included in the fluid to maintain clean metal surfaces and to transport these contaminants to the surface so the preconditioning fluid circulation system can remove them out from the system. Non-limiting example detergents that may be useful in the preconditioning fluid include $Na^+$, $Ca^{2+}$, or $Mg^{2+}$ salts of alkyl benzene sulfonates; $Na^+$, $NH_4^+$, $Zn^{2+}$, $Pb^{2+}$, $Ca^{2+}$, or $Ba^{2+}$ salts of alkyl naphthalene sulfonates; $Ca^{2+}$, $Ba^{2+}$ or $Mg^{2+}$ salts of sulfurized alkylphenols, in which alkyl is hexy, octyl, nonyl, decyl, dodecyl and hexadecyl derivatives. Those of ordinary skill in the art will also appreciate that the detergent may comprise any combination thereof, for example, that would achieve the same objective. The amount of detergent in the preconditioning fluid will generally range from 10 ppm to 5000 ppm. In embodiments, the preconditioning fluid contains in a range from 100 to 2500 ppm of a detergent. In some embodiments, the preconditioning fluid may include from 10 to 5000 ppm of one or more detergents, and the detergent may comprise an alkyl benzene sulfonate, an alkyl naphthalene sulfonate, a sulfurized alkylphenol metal salt, or any combination thereof.

Demulsifying Agents:

A demulsifying agent may be included in the preconditioning fluid for mitigating the effect of contamination from brine, water, and sand in the fluid during RF heating. These contaminants may contribute to inefficiencies in antenna operation by increasing the conductivity and reducing the dielectric breakdown of the preconditioning fluid. Non-limiting example demulsifying agents that may be useful in the preconditioning fluid include a polyalkoxylate block copolymer, an ester derivative of a polyalkoxylate block copolymer, a alkylphenol-aldehyde resin alkoxylate, a polyalkoxylate of a polyol or glycidyl ether, or any combination thereof. In all of these cases, alkyl may be hexy, octyl, nonyl, decyl, dodecyl or hexadecyl derivatives The amount of demulsifying agent in the preconditioning fluid will generally range from 10 to 500 ppm. In embodiments, the preconditioning fluid contains in a range from 20 to 400 ppm of a demulsifying agent. In some embodiments, the preconditioning fluid may include from 10 to 500 ppm of one or more demulsifying agents, and the demulsifying agent may comprise a polyalkoxylate block copolymer, an ester derivative of a polyalkoxylate block copolymer, an alkylphenol-aldehyde resin alkoxylate, a polyalkoxylates of a polyol, a polyalkoxylate of a glycidyl ether, or any combination thereof.

Oxygen Scavengers:

An oxygen scavenger or radical scavenger may be included in the preconditioning fluid to reduce the decomposition and oxidation of the fluid during high temperature RF heating using the antenna. Non-limiting example scavengers include aromatic amines (pyridine, aniline etc.); alkyl sulfides (with a general formula $R—S_x—R—S—R$ in which R is hexy, octyl, nonyl, decyl, dodecyl or hexadecyl); sterically hindered phenols (e.g., 2,6-ter-butyl, alkyl phenol in which alkyl is hexy, octyl, nonyl, decyl, dodecyl and hexadecyl derivatives). Those of ordinary skill in the art will also appreciate that the oxygen scavenger may comprise any combination thereof, for example, that would achieve the same objective. The amount of scavenger in the preconditioning fluid will generally range from 10 ppm to 500 ppm. In embodiments, the preconditioning fluid contains in a range from 20 to 400 ppm of a scavenger. In some embodiments, the preconditioning fluid may include from 10 to 500 ppm of one or more radical scavengers, and the radical scavenger may comprise an aromatic amines, an alkyl sulfides, a hindered phenol, or any combination thereof.

Properties:

The preconditioning fluid composition that is circulated to the antenna facilitates efficient operation of the antenna. Thus, a suitable circulating preconditioning fluid has a low dielectric constant and a low viscosity, and is thermally stable at the maximum temperature to which it will be subjected when circulated through the antenna. In one embodiment, the preconditioning fluid has a dielectric constant less than or equal to 3, a loss tangent no greater than 0.02 and a dielectric breakdown greater than 100 kV per inch. In another embodiment, the preconditioning fluid has a dielectric constant of less than 2.5, e.g., in a range from 1.0-2.5. An example circulating preconditioning fluid has a viscosity of less than 5 cP at 100° C., or, in one embodiment, in a range from 2-5 cP at 100° C. An example preconditioning fluid has a water content of less than 40 ppm in another embodiment; a water content of less than 25 ppm in another embodiment; and a water content of less than 20 ppm in yet a third embodiment.

With respect to the fluid in the well and in contact with the antenna when the antenna and well fluids have been conditioned ("operating fluid"), the fluid is suitable for use in the antenna such that an operational power level of radio frequency electrical energy can be applied to the decontaminated antenna, to provide thermal energy to the hydrocarbon-bearing formation (e.g., without risking an electrical short). In one embodiment, the operating fluid is characterized by a viscosity of less than 5 cP at 100° C. and a total aromatics content of less than 0.5 wt.

Testing:

In one embodiment, to determine that the system is suitably clean of contaminants, conductive metal particles, oxides or sulfides, etc., from the antenna and/or coaxial cable that may hinder operation of the antenna, the system is attached to a high voltage power supply and a high voltage in the range of 2000 to 10,000 volts is applied to the system. If more than 1 to 20 milliamps flows during this test, the system is deemed to not pass the high voltage test and the antenna/coaxial cable is subsequently flushed again until the system passes the high voltage test.

In one embodiment, the antenna and coaxial cable is tested with a high voltage tester equipped with an automatic current cutoff switch which can be set to trip in the range of 1 to 20 mA, and more preferably from 5 to 15 mA to prevent development of a permanent arc trail on the surface of the dielectric centralizers or spacers used in the antenna or coaxial cable. In one embodiment, the high voltage tester has lower limit of 50 Hz. In another embodiment, the high voltage tester has an upper limit of 600 Hz. In a third embodiment, the high voltage tester has a range of frequency ranging from 50-60 Hz.

In some embodiments, testing the RF antenna may occur before decontamination, after decontamination, or both with a voltage tester equipped with an automatic current cutoff switch set to trip in the range of 1 to 20 mA. In some embodiments, testing the RF antenna may occur before decontamination, after decontamination, or both with a voltage tester equipped with an automatic current cutoff switch set to trip in the range of 5 to 15 mA. In some embodiments, testing the RF antenna may occur before decontamination, after decontamination, or both with a voltage tester having a frequency range of at least 50 Hz and at most 600 Hz.

Treating/Recycling Preconditioning Fluid:

The preconditioning fluid may contain additives, detergents, etc. that may hinder the final operation of the antenna. In one embodiment, undesirable additives or detergents, for example, may be removed by a treating unit. The treating unit can be a clay treater. In the treating unit, the fluid is treated until the electrical breakdown potential of the fluid exceeds 100 kV/inch at 60 Hz and the water contaminant level remains below 40 ppm, at which point the hydrocarbon based fluid in the well meets the conditions for an operational fluid.

In one embodiment, the treating unit comprises an inlet for recovering spent fluid from the wellbore; filtering means for removing particulates from the spent fluid; dewatering means for removing water from the spent fluid; an outlet for recovering preconditioning fluid for passing to the antenna; and an analyzer for monitoring the contaminant concentration in the preconditioning fluid produced in the treating unit, including a water limit of less than 40 ppm of dissolved water, free water, emulsified water, or any combination thereof.

In yet another embodiment, an additional treating unit is employed to remove those additives that cause the dielectric strength of the preconditioning fluid to be less than 100 kV/in at 60 Hz. In the additional treating unit, filtration can be used to remove conductive particles as these particles can cause electrical shorts. Examples of conductive particles to be removed include metals, metal oxides, chalcogenides, or any combination thereof. In one embodiment of a treating unit, after flowing at least one well volume of fluid through the filter, the number of metal particles caught in the filter with an average particle size greater than 0.1 inches is less than 10, and with no conductive particle with average particle size of greater than 0.5 inches. In one embodiment, the fluid is recirculated through multiple cycles of (new) filters until very few if any conductive particles with size of >0.1 inches remain.

The preconditioning fluid is further treated to be thermally stable at the maximum operating temperature of the antenna, have a low viscosity (e.g., <5 cP at 100° C.), and a composition characterized by a low aromatic content (e.g., <0.5% wt.), a high paraffinic content (e.g., >99% wt.), and a low water content (e.g., less than 25 ppm). In one embodiment, the preconditioning fluid comprises from 10 to 5000 ppm of one or more dispersants. In one embodiment, the preconditioning fluid comprises from 10 to 5000 ppm of one or more detergents. In one embodiment, the preconditioning fluid comprises from 10 to 500 ppm of one or more demulsifying agents. In one embodiment, the preconditioning fluid comprises from 10 to 500 ppm of one or more oxygen scavengers (or radical scavengers).

Figures Illustrating Embodiments:

Reference will be made to the figures to further illustrate embodiments of the invention.

RF Heating System:

FIG. 1 illustrates an embodiment of the RF heating system, prior to supplying an operational power level of electromagnetic energy to the antenna for providing thermal energy to the hydrocarbon-bearing formation. The system includes an RF antenna 110 extending within wellbore 134 into a hydrocarbon-bearing formation 138. The hydrocarbon-bearing formation contains hydrocarbons (e.g., petroleum) in gaseous, liquid, and/or solid phases. The RF generator 112 (or generating source or generating unit) generates RF electric energy that is delivered to the antenna 110. The RF generator is typically situated at the surface 136 in the vicinity of the wellhead 132.

The system includes a RF antenna 110 receiving electromagnetic energy from RF generator 112, at the wellhead 132, through transmission line 114, having outer conductor 116 and inner conductor 118 and fluid passageway 120 there between for passing preconditioning fluid 128 through the transmission line from the treating unit 122 to antenna 110. Preconditioning fluid treating unit 122 at the wellhead 132 supplies preconditioning fluid through a supply conduit 124 to the antenna 110, and recovers spent fluid 130 from the antenna through recovery conduit 126. The antenna 110 is positioned within a wellbore 134 extending from the earth's surface 136 into the hydrocarbon-bearing formation 138.

The wellbore 134 can be a vertical, horizontal, or diagonal wellbore, or some combination thereof. The wellbore 134 is provided with casing material 140 lining the inside of the wellbore, for protecting the wellbore 134 from contamination by materials supplied to or produced through the wellbore, and for reducing the risk of wellbore collapse during use. The well casing 140 is largely of a material generally used in wellbores of this type. While different materials may be used for different applications, well casings are generally made of steel, the specific composition being selected for the particular application. In the RF heating system, a portion 142 of the well casing is transparent to RF radiation. A suitable material may be a dielectric material having both a near-zero loss tangent and a dielectric constant less than 7 in the selected portion of the RF spectrum. A transparent (to RF radiation) well casing 142 lines the wellbore 134 in a region in which the hydrocarbon occurs within the formation. The well casing may extend in the wellbore through a portion of or the full extent of the hydrocarbon-bearing formation 138. In general, the well casing 142 extends in the wellbore 134 for at least the length of RF antenna 110. At the transition in the well casing between the well casing and the steel casing, the two casing types are bonded through crossover members 144 which provide leak-tight joints between the two materials having dissimilar physical and chemical properties.

The annular region 146 inside of the well casing and between the well casing and the antenna permits the passage of organic and aqueous fluids and steam. In some embodiments, the annular region has a cross-sectional distance in a range from about 1 inch to about 36 inches.

A bridge plug 148 may be installed in the wellbore below the antenna for isolating the region below the plug from the antenna. In one embodiment, water in the vicinity of the antenna, is permitted to settle to the bottom of the wellbore below the antenna, before full power is applied to the antenna. Operation of the bridge plug 148 permits isolation of the settled aqueous phases from the operating antenna. In one embodiment, the bridge plug 148 is set using a drill string prior to running the antenna into the well.

The transmission line 114 provides an electrical connection between the RF generator 112 and the antenna 110, and delivers the RF signals from the RF generator 112 to the antenna 110. The transmission line 114 may include a plurality of separate segments which are successively coupled together as the RF antenna 110 is run in or fed down the wellbore 132. Particularly for vertical wellbores, the transmission line may support the weight of the antenna 110 in the wellbore. In some applications, the transmission line 114 may be contained within a conduit that supports the antenna 110 in the appropriate position within the hydrocarbon-bearing formation 138, and is also used for raising and lowering the antenna 110 into place. Use of rigid conduit provides a transmission line that can be easily inserted and removed from the wellbore. One or more insulating materials may be included inside of the conduit to separate the transmission line 114 from the conduit. A dielectric may also surround the antenna 110, if desired. In some embodiments the conduit is sufficiently strong to support the weight of the antenna 110, which can weigh as much as 5,000 pounds to 100,000 pounds in some embodiments.

In one embodiment, the transmission line 114 forms a coaxial cable, with an inner conductor 118 and an outer conductor 116 separated by a dielectric material, although other transmission line conductor configurations may also be used in different embodiments. In one embodiment, a hollow central portion within the inner conductor defines a first passageway (e.g., a supply passageway) of a dielectric liquid circuit, and the space between the inner conductor and the outer conductor defines a second passageway (e.g., a return passageway) of a dielectric liquid circuit. The dielectric liquid circuit allows a dielectric fluid to be circulated through the coaxial transmission line 114 to the antenna 110.

A fluid circulation system supplies preconditioning fluid to the antenna, recovers spent fluid from the antenna, and treats the recovered spent fluid for return to the antenna. The fluid circulation system includes a fluid treating unit 122 for preparing the dielectric fluid for flow to the antenna. The dielectric fluid treating unit may include one or more process steps, each being conducted in a single piece of equipment or in multiple pieces of equipment. During treatment, the fluid is conditioned to remove contaminants that may degrade antenna performance.

In the embodiment as illustrated, the preconditioning fluid 124 is circulated through RF antenna 110, and returned as spent fluid 126 for analysis, contaminant removal, and in some cases, cooling in treating unit 122. Fluid circulation may include flow within the antenna 110, outside the antenna in the annular region 146 between the antenna 110 and a well casing 142, or both. The preconditioning fluid may be supplied to the annular region 146 outside the antenna, from where the fluid flows into and through the antenna 110 before being recovered and treated for recycle. Alternatively, the preconditioning fluid may flow through the antenna 110 for removing contaminants and excess heat, and from there passing out of the antenna and into the annular region 146 before being recovered and treated. Alternatively, the preconditioning fluid may pass through one passageway (e.g., a first passageway) within the antenna, and return for treating through a second passageway in the antenna. The preconditioning fluid circulation system is generally controlled to maintain a continuous flow of the circulating preconditioning fluid throughout the antenna at rates of at least 1 gallon/min, and in one embodiment between 1-100 gallon/min.

The preconditioning fluid 128 may be supplied to the antenna 110 through one or more supply conduits 124 in fluid communication with the preconditioning fluid circulation system. In one embodiment, the antenna is preconditioned at a temperature in a range from 20°-200° C.; in another embodiment, in a range from 50° C.-175° C. In one embodiment, the antenna is preconditioned at a pressure in a range from 1 atm-20 atm; in another embodiment, in a range from 1 atm-10 atm. In one embodiment, one or more supply conduits 124 supply preconditioning fluid 128 to the antenna, and one or more recovery conduits 126 in fluid communication with the preconditioning fluid treating system 122 recovers spent fluid 130 for treating and recycle. The supply conduit 124 and/or a recovery conduit 126 may extend into the wellbore 134 parallel with the antenna 110. In one embodiment, a conduit extending into the wellbore is, at least in part, of a material that is transparent to RF radiation.

In one embodiment, the transmission line 114 is useful for supplying preconditioning fluid to the antenna. A coaxial cable transmission line useful in the method includes an inner conductor 118 and an outer conductor 116 separated by a fluid passageway 120. The fluid passageway 120 between the inner and outer conductors provides a passageway for flowing preconditioning fluid from the treating unit 122 to the antenna, or in the reverse direction from antenna to the treating unit 122. In one embodiment, the inner conductor of the transmission line is hollow, and is used as a second passageway for preconditioning fluid supplied to, or returned from the antenna. If a coaxial transmission line is employed for conducting the preconditioning fluid to the antenna, it is desirably constructed so as to introduce little or no contaminants to the preconditioning fluid flowing through it. For example, the RF antenna is in electrical communication with the transmission line having a second fluid passageway, and the second fluid passageway may be in fluid communication with the first fluid passageway of the antenna such that the preconditioning fluid is passed from the treating unit through the second passageway in the transmission line to the first passageway of the antenna. The transmission line may also be in electrical communication with the generating unit, for transmitting electrical energy from the generating unit to the antenna, for providing thermal energy to the hydrocarbon-bearing formation.

Figure 2:
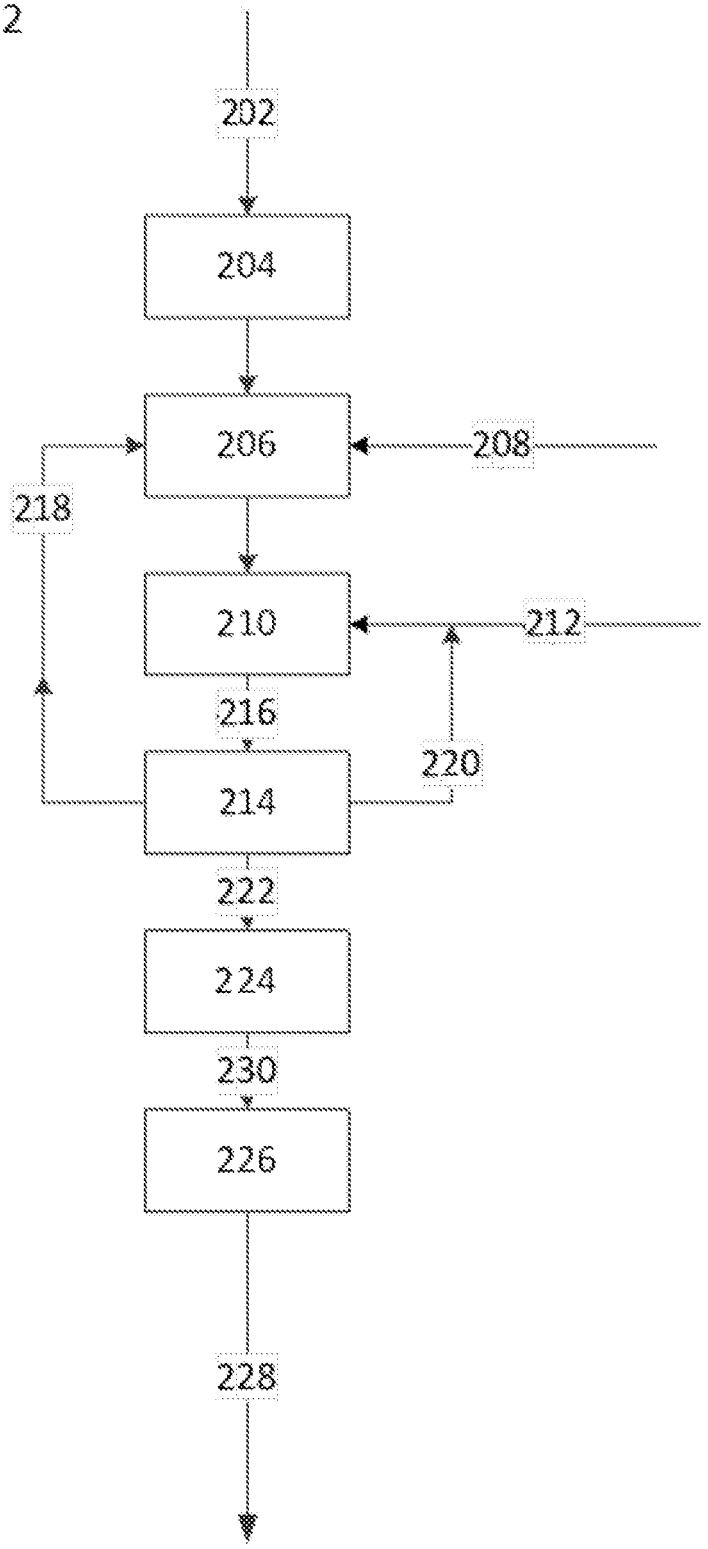
FIG. 2 illustrates an embodiment of the fluid treating unit.

FIG. 2 illustrates a system for treating the preconditioning fluid. During treating, spent fluid 202 is optionally cooled in step 204 and treated in step 206 to remove contaminants prior to recycle. Ideally, the fluid is cooled without introducing aqueous, organic, ionic, and/or metallic contaminants into the fluid. Cooling may be controlled by downstream requirements in the fluid circulation system; temperatures below 100° C., or in a range from 25° C. to 80° C., are typical.

Treating the spent fluid may also include removing conductive inorganic and metallic contaminants that are flushed from the antenna and/or wellbore during circulation. Typical methods for removing the contaminants include filtration, aqueous extraction, centrifugation, ion exchange, adsorption on a solid adsorbent, or any combination thereof.

Treating the spent fluid may also include removing entrained or emulsified water in the spent fluid. Typically, the water is separated from the preconditioning fluid by settling or using a 2-phase liquid-liquid separator, which may include use of a demulsifier 208 added to the preconditioning fluid to enhance water separation. Water may also be separated from preconditioning fluid by absorption of water on a solid absorbent such as silica gel, calcium sulfate, or a zeolitic adsorbent, by filtering the water-containing preconditioning fluid, by distillation, by heating using radio frequency heating, by freeze drying, or any combination thereof. Chemical decomposition fragments may be removed by distillation or adsorption on a solid adsorbent. Treating the preconditioning fluid may include filtering to remove particulates, such as sand or metal particles, that may have been picked up in the preconditioning fluid during passage through the antenna or through the wellbore. Treating the spent fluid may include adding one or more of the additives that are depleted during use.

While a preconditioning process 206 is shown in FIG. 2 as a single step, the preconditioning process may involve multiple steps to efficiently manage particle removal, demulsifying, pH control, and removal of decomposition products.

In the embodiment illustrated in FIG. 2, the preconditioning fluid passes to a mixing step 210 for mixing with make-up fluid 212, which is provided in an amount necessary to compensate for fluid losses elsewhere in the system. A cleaning step 206 and a mixing step 210 are shown as separate steps in FIG. 2. In practice, these two processes may take place in a single step. Alternatively, the cleaning step may involve a number of sub-steps, any or all of which may involve mixing and/or addition of make-up.

Partially preconditioning fluid 216 passes to an analysis step 214 to ensure that the circulating preconditioning fluid is formulated for antenna operation. Treatment conditions may be modified via a quality control feedback loop 218 to ensure quality. In some cases, it may be necessary to return preconditioning fluid to the preconditioning step 206, or to increase the amount of make-up 212 blended with the preconditioning fluid, via a make-up control feedback lookup 220, to meet requirements.

Preconditioning fluid 222 that meets requirements for physical and chemical properties is then passed to the antenna using pumping means 224. If needed, the pumped fluid 230 may undergo further temperature adjustment 226 to meet requirements. In one embodiment, the treated fluid 228 has a temperature of less than 100° C., and in one embodiment a temperature in a range from 25° C. to 80° C.

Preconditioning fluid 228 that is supplied to the antenna for maintaining antenna operation is characterized by a preconditioning dielectric constant of less than or equal to 3, and a loss tangent no greater than 0.02.

Preconditioning fluid is circulated through the antenna to meet specifications prior to applying an operational power level of radio frequency electrical energy to the RF antenna or prior to applying a reduced amount of radio frequency electrical energy below the operational power level. Preconditioning fluid leaving the antenna is recovered, analyzed, and optionally treated for recycle. If the spent fluid meets or exceeds compositional or performance property standards, radio frequency electrical energy is supplied to the antenna, up to and including an operational power level. In one embodiment, the target property standard is a contaminant level of less than 40 ppm. In another embodiment, the target property standard is a water content of less than 40 ppm. In another embodiment, the target property standard is a water content of less than 25 ppm. In another embodiment, the standard property of the spent fluid may include a dielectric constant of less than or equal to 3, and a loss tangent no greater than 0.02.

Before RF power can be applied to the antenna, the final and last step is to measure the electrical breakdown potential of the fluid. For proper operation of the antenna, the electric breakdown potential of the pre-conditioning fluid must exceed 100 kV per inch at 60 Hz. ASTM D-877 is one method that can be used to make this measurement. It is possible that due to additives and detergents used in the preconditioning step that fluid will not pass this last critical measurement, thus in case the preconditioning fluid must be circulated through an absorbent bed to remove those additives or detergents that have lowered the electrical breakdown potential of the fluid. This absorbent may be a clay like Fuller's earth or attapulgus clay. Once the electrical breakdown strength of the preconditioning fluid has exceeded 100 kV per inch as measured at 60 Hz, then the fluid is now deemed clean, and RF energy can be applied to the antenna. The fluid in the well is now an "operating fluid" or "insulating fluid".

In one embodiment, during operation of the RF antenna, the state of the fluid in the well is monitored. This can be accomplished by circulating the operating fluid through the antenna, and collecting a sample. If the operating fluid becomes sufficiently contaminated by either water so that the water content exceeds 40 ppm; undesirable high levels of conductive particles for example as the result of corrosion or contamination, or that the electric breakdown strength is less than 100 kV per inch as measured at 60 Hz, it may be necessary to turn off the RF energy, and decontaminate the well.

Contaminants:

During preconditioning the antenna, a preconditioning fluid is circulated through the system for removing contaminants, such as conductive contaminants, from the antenna. In one embodiment, contaminants that remain in the antenna following preconditioning adversely affect the performance of the antenna by creating conductivity pathways, sparking, shorting, and other undesirable electrical effects. Such contaminants may originate during antenna construction or installation in the wellbore, and/or may result from contaminants present in the wellbore during drilling operations. The contaminants are defined as any materials from the antenna or the wellbore that dissolve or become suspended in the operating fluid during circulation, and decomposition products from said fluid that are generated in the fluid while in contact with the antenna or wellbore during operation. The decomposition products may arise from the base fluid or from additives supplied in the base fluid. Examples include acids and other oxidation products, and hydrogen sulfide from decomposition of additives in the fluid. Materials that may become entrained in the circulating dielectric fluid include oxygen from entrained air, sulfur or nitrogen containing compounds from the formation, inorganic minerals and ionic materials from the formation, water and other aqueous or organic fluids from the formation or from drilling and production operations, dust particles from the environment, and metal particles from the antenna. In some cases, contaminants are introduced to the fluid from anti-seize compounds or pipe dope used to construct or deploy the antenna. Entrained metal particles may include one or more of iron, aluminum, or copper. Conductive particles are particularly undesirable, because they can form dendrites that grow and subsequently short out the antenna and/or transmission line.

In one embodiment, a high voltage tester attached to the antenna or transmission line and a 60 Hz high voltage signal in the range of 2 to 20 kV is applied to the system. If more than 10 milliamps flows during this test, the system is deemed to have not passed the high voltage test, and the antenna and/or transmission line is subsequently flushed until the system passes the high voltage test. This high voltage test can be used as a guide of the conductive particle level in the well. If less than 10 milliamps of current flows when a 60 Hz 2 to 20 kV, then the well and antenna is free of a high undesirable level of conductive particles.

In one embodiment, one well volume of fluid is passed through a new clean filter, and the size and number of conductive particles caught by the filter is used to judge the "cleanliness" of the well.

In one embodiment, the electric breakdown test follows the applied high voltage test or the conductive particle count test.

In one embodiment, the preconditioning fluid is circulated through a cleaning process until spent fluid recovered from the antenna contains less than 40 ppm (or in one embodiment less than 25 ppm) of dissolved water. In another embodiment, the circulation continues until the spent fluid has a dielectric constant less than or equal to 3 (or less than 2.5 in one embodiment and in a range of 1.0-2.5 in another embodiment), and a loss tangent no greater than 0.02.

In one embodiment, the preconditioning fluid reaches the operational fluid status once the dielectric breakdown test at 60 Hz exceeds 100 kV per inch taken on random fluid samples drawn multiple times as at least one well volume is circulated through the well.

EXAMPLES

The following examples are non-limiting illustrations of the inventive concepts.

Example 1

Antenna operation is monitored to maintain contaminant levels within the antenna at low levels, such that the antenna operation is not adversely affected by the contaminants. Contaminants that are produced in the antenna, or that migrate into the antenna from an external source, are removed by preconditioning fluid flowing through the antenna. Contaminant concentrations may be monitored by analyzing the preconditioning fluid recovered from the antenna. Recovered preconditioning fluid that contains greater than 50 ppm water, and in one embodiment greater than 25 ppm, indicates that additional steps are required for reducing the water content in a preconditioning fluid within the antenna. Recovered preconditioning fluid containing measurable amounts of ionic species or metals also indicate mitigation.

Example 2

Prior to applying an operational power level of radio frequency electrical energy to an RF antenna in a hydrocarbon-bearing formation, preconditioning fluid is flowed through at least one passageway in the antenna. Recovered preconditioning fluid from the antenna is analyzed for contaminants, and found to contain measurable amounts of metallic particles. Preconditioning fluid is continued to flow through the antenna until the recovered preconditioning fluid contains no measurable metallic particles. After testing the electric breakdown strength and determining it is greater than 100 kV per inch at 60 Hz, an operational power level of radio frequency electrical energy is then applied to the RF antenna.

Example 3

Prior to applying an operational power level of radio frequency electrical energy to an RF antenna in a hydrocarbon-bearing subterranean formation, preconditioning fluid is flowed through at least one passageway in the antenna. Recovered preconditioning fluid from the antenna is analyzed for contaminants, and found to contain at least 40 ppm, and in some embodiments at least 25 ppm water. Preconditioning fluid is continued to flow through the antenna until the recovered preconditioning fluid contains less than 25 ppm water. After testing the electric breakdown strength and determining it is greater than 100 kV per inch at 60 Hz an operational power level of radio frequency electrical energy is then applied to the RF antenna.

Example 4

Figure 3:
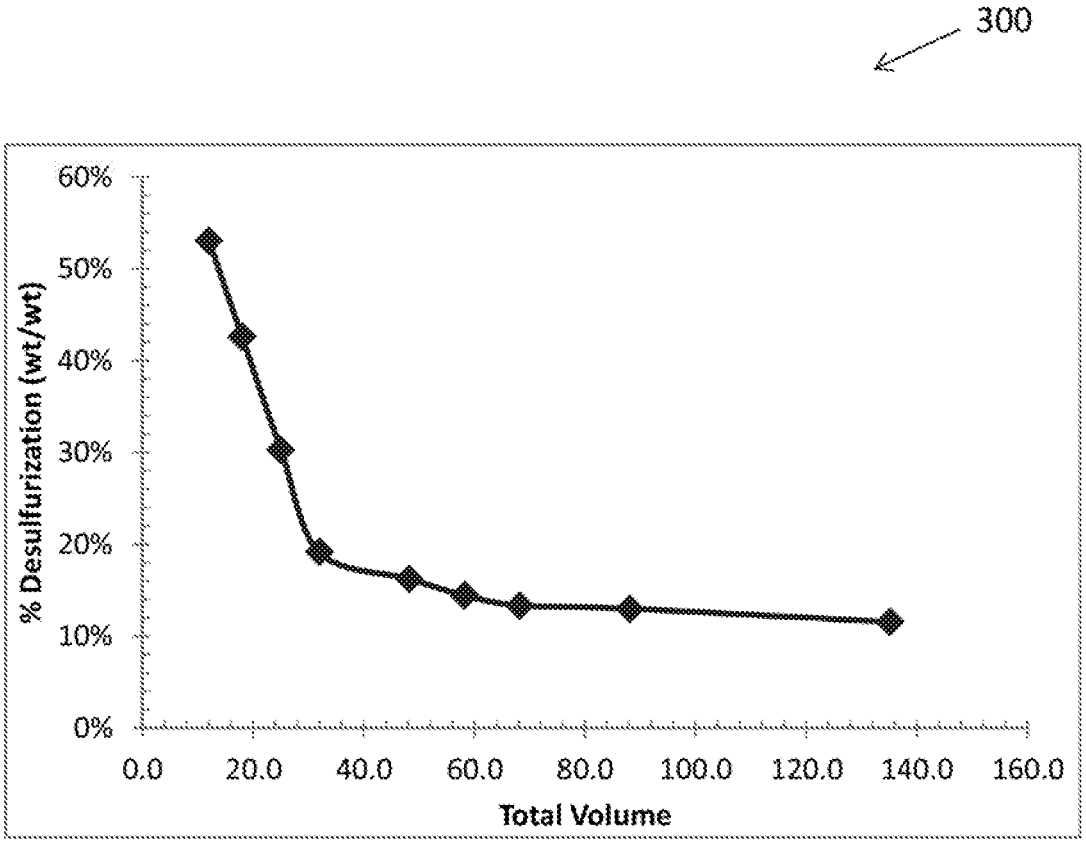
FIG. 3 illustrates one example of a reduction in sulfur content of a contaminated hydrocarbon fluid after passage over a clay bed.

A contaminated hydrocarbon fluid containing solvent (boiling point between 390-600° F.) was pumped through 10 ml of an attapulgus clay bed using a syringe pump at a rate of 100 mL/h at room temperature and the concentration of sulfur in the hydrocarbon fluid was measured before and after clay treatment. FIG. 3 shows the reduction in sulfur content of a contaminated hydrocarbon fluid after passage over a clay bed. FIG. 3 illustrates up to 50% w/w sulfur removal (desulfurization) initially, but the treatment bed quickly becomes saturated for all but the most polar sulfur compounds, nonetheless, this example demonstrates that attapulgus clay may be used to remove polar compounds.

The claimed subject matter is not to be limited in scope by the specific embodiments described herein. Indeed, various modifications of one or more embodiments disclosed herein in addition to those described herein will become apparent to those skilled in the art from the foregoing descriptions. Such modifications are intended to fall within the scope of the appended claims.

What is claimed is:

1. A method for heating a subterranean formation, comprising:

installing a radio frequency (RF) antenna in a hydrocarbon-bearing formation, wherein the RF antenna includes at least one passageway for fluid flow;

circulating a preconditioning fluid through the at least one passageway of the RF antenna to decontaminate the RF antenna, wherein the preconditioning fluid comprises a hydrocarbon fraction, mineral oil, silicon oil, ester-based oil, or any combination thereof, and wherein the preconditioning fluid for decontaminating the RF antenna has a paraffinic content of at least 90 wt. %; and transmitting electromagnetic energy to the decontaminated RF antenna to provide thermal energy to the hydrocarbon-bearing formation.

2. The method of claim 1, wherein the hydrocarbon fraction comprises a jet fuel boiling range, a diesel fuel boiling range, or any combination thereof.

3. The method of claim 1, wherein the preconditioning fluid for decontaminating the RF antenna comprises mono-aromatics, di-aromatics, or any combination thereof.

4. The method of claim 1, wherein the preconditioning fluid for decontaminating the RF antenna contains less than 40 ppm of dissolved water, free water, emulsified water, or any combination thereof.

5. The method of claim 1, wherein the preconditioning fluid for decontaminating the RF antenna has a total aromatics content of less than 0.5 wt. % and less than 0.01 wt. % di-aromatics.

6. The method of claim 1, wherein the preconditioning fluid for decontaminating the RF antenna is characterized by a viscosity of less than 5 cP at 100° C.

7. The method of claim 1, wherein the preconditioning fluid for decontaminating the RF antenna has a dielectric constant of less than 2.5.

8. The method of claim 1, wherein the preconditioning fluid has an electric breakdown strength greater than 100 kV per inch at 60 Hz.

9. The method of claim 1, wherein the preconditioning fluid for decontaminating the RF antenna further comprises: from 10 to 5000 ppm of one or more dispersants; from 10 to 5000 ppm of one or more detergents; from 10 to 500 ppm of one or more demulsifying agents; and from 10 to 500 ppm of one or more oxygen scavengers.

10. The method of claim 1, wherein the preconditioning fluid comprises one or more dispersants, and wherein the one or more dispersants comprise a succinimide, a succinate ester, an alkylphenol amide, or any combination thereof.

11. The method of claim 1, wherein the preconditioning fluid comprises one or more detergents, and wherein the one or more detergents comprise an alkyl benzene sulfonate, an alkyl naphthalene sulfonate, a sulfurized alkylphenol metal salt, or any combination thereof.

12. The method of claim 1, wherein the preconditioning fluid comprises one or more demulsifying agents, and wherein the one or more demulsifying agents comprise a polyalkoxylate block copolymer, an ester derivative of a polyalkoxylate block copolymer, an alkylphenol-aldehyde resin alkoxylate, a polyalkoxylates of a polyol, a polyalkoxylate of a glycidyl ether, or any combination thereof.

13. The method of claim 1, wherein the preconditioning fluid comprises one or more oxygen scavengers, and wherein the one or more oxygen scavengers comprise an aromatic amine, an alkyl sulfide, a hindered phenol, or any combination thereof.

14. The method of claim 1, further comprising: recycling the preconditioning fluid by i) recovering a spent fluid from decontaminating the RF antenna; and ii) passing the spent fluid through a treating unit to remove contaminants thereby recycling the preconditioning fluid.

15. The method of claim 1, further comprising: testing the RF antenna before decontamination, after decontamination, or both with a voltage tester having a frequency range of at least 50 Hz and at most 600 Hz and equipped with an automatic current cutoff switch set to trip in the range of 1 to 20 mA.

16. The method of claim 1, wherein a transmission line has a second passageway, the second passageway being in fluid communication with the first passageway of the RF antenna, wherein the preconditioning fluid is passed from a treating unit through the second passageway in the transmission line to the first passageway of the RF antenna, and wherein the transmission line is also in electrical communication with a generating unit for transmitting electrical energy from the generating unit to the RF antenna for providing the thermal energy to the hydrocarbon-bearing formation.

17. The method of claim 1, wherein the wellbore comprises a RF transparent casing string in at least a portion of the hydrocarbon-bearing formation, and wherein the RF antenna extends at least into the RF transparent casing string, forming an annular volume within the wellbore between the RF transparent casing string and the RF antenna.

18. The method of claim 17, wherein the RF antenna is decontaminated by:

passing the preconditioning fluid through the RF antenna to generate a spent fluid; and recovering the spent fluid from the RF antenna through the annular volume within the wellbore between the RF transparent casing string and the RF antenna.

19. The method of claim 1, further comprising: recycling the preconditioning fluid by i) recovering a spent fluid from decontaminating the RF antenna; and ii) passing the spent fluid through a treating unit to remove contaminants thereby recycling the preconditioning fluid, and wherein the treating unit comprises: an inlet for recovering the spent fluid; a filter for removing particulates from the spent fluid; a dewatering unit for removing water from the spent fluid; an outlet for recovering the preconditioning fluid for passing to the RF antenna; and an analyzer for monitoring the contaminant concentration in the preconditioning fluid produced in the treating unit.

20. The method of claim 1, wherein decontaminating the RF antenna comprises: flowing the preconditioning fluid through the RF antenna for a time sufficient to reduce the contaminant level in a spent fluid to 40 ppm or less of dissolved water, free water, emulsified water, or any combination thereof prior to transmitting the electromagnetic energy from a generating unit to the decontaminated RF antenna.

21. The method of claim 1, wherein a unit for generating the electromagnetic energy has a frequency in a range from 5 kilohertz to 20 megahertz, and has a power within a range from 50 kilowatts to 2 megawatts to the RF antenna.

22. The method of claim 1, further comprising:

applying a high voltage signal greater than 2000 V to the RF antenna, providing a transmission line in electrical communication with a generating unit and in electrical communication with the RF antenna for transmitting the electromagnetic energy from the generating unit to the decontaminated RF antenna, or both; and measuring leakage current.

23. A method for heating a subterranean formation, comprising:

installing a radio frequency (RF) antenna in a hydrocarbon-bearing formation, wherein the RF antenna includes at least one passageway for fluid flow;

circulating a preconditioning fluid through the at least one passageway of the RF antenna to decontaminate the RF antenna, wherein the preconditioning fluid comprises a hydrocarbon fraction, mineral oil, silicon oil, ester-based oil, or any combination thereof, and wherein the preconditioning fluid for decontaminating the RF antenna further comprises: from 10 to 5000 ppm of one or more dispersants; from 10 to 5000 ppm of one or more detergents; from 10 to 500 ppm of one or more demulsifying agents; and from 10 to 500 ppm of one or more oxygen scavengers; and transmitting electromagnetic energy to the decontaminated RF antenna to provide thermal energy to the hydrocarbon-bearing formation.

24. A method for heating a subterranean formation, comprising:

installing a radio frequency (RF) antenna in a hydrocarbon-bearing formation, wherein the RF antenna includes at least one passageway for fluid flow;

circulating a preconditioning fluid through the at least one passageway of the RF antenna to decontaminate the RF antenna, wherein the preconditioning fluid comprises a hydrocarbon fraction, mineral oil, silicon oil, ester-based oil, or any combination thereof, and wherein the preconditioning fluid comprises one or more demulsifying agents, and wherein the one or more demulsifying agents comprise a polyalkoxylate block copolymer, an ester derivative of a polyalkoxylate block copolymer, an alkylphenol-aldehyde resin alkoxylate, a polyalkoxylates of a polyol, a polyalkoxylate of a glycidyl ether, or any combination thereof; and transmitting electromagnetic energy to the decontaminated RF antenna to provide thermal energy to the hydrocarbon-bearing formation.

* * * * *